United States Patent [19]

Katoh et al.

[11] Patent Number: 4,965,637

[45] Date of Patent: Oct. 23, 1990

[54] CONTROL DEVICE FOR AN IMAGE FORMING APPARATUS

[75] Inventors: Eiichi Katoh; Koichi Asakura; Yutaka Hasegawa, all of Tokyo; Toshiro Bando, Yokohama, all of Japan

[73] Assignee: Ricoh Company, Ltd., Tokyo, Japan

[21] Appl. No.: 379,366

[22] Filed: Jul. 13, 1989

[30] Foreign Application Priority Data

Jul. 26, 1988 [JP] Japan ..... 63-184716

[51] Int. Cl.[5] ..... G03G 21/00

[52] U.S. Cl. ..... 355/246; 355/204; 355/205

[58] Field of Search ..... 355/246, 205, 206, 209, 355/208, 203, 204; 346/160

[56] References Cited

U.S. PATENT DOCUMENTS

| | | | |
|---|---|---|---|
| 4,502,778 | 3/1985 | Dodge et al. | 355/206 |
| 4,505,572 | 3/1985 | Ashida et al. | 355/246 |
| 4,583,836 | 4/1986 | Taniguchi et al. | 355/205 |

*Primary Examiner*—A. T. Grimley
*Assistant Examiner*—Thu A. Dang
*Attorney, Agent, or Firm*—Oblon, Spivak, McClelland, Maier & Neustadt

[57] ABSTRACT

A control device for a copier is disclosure which detects an error of a drive system and which drives a photoconductive element. The device includes a motor and uses an output of a toner sensor responsive to the density of a toner image which is formed on the photoconductive element. The control device checks the drive system for an error by computing output data of the toner sensor appearing when the photoconductive element is rotated by the drive system and when it is held in a halted mode.

4 Claims, 6 Drawing Sheets

CONTROL DEVICE FOR AN IMAGE FORMING APPARATUS

BACKGROUND OF THE INVENTION

Field of the Invention

The present invention relates to a copier or similar image forming apparatus and, more particularly, to a control device for an image forming apparatus which is capable of detecting errors of a drive system of the apparatus by using a toner sensor that serves to sense toner density.

Discussion of the Background

In a copier, for example, various driven units incorporated in a copier body, especially a photoconductive element, are generally driven by a drive system which includes a motor. Control over such a drive system has customarily been implemented with a slitted disk which is mounted on a rotatable portion of a photoconductive element or similar member which is driven by a motor, and a photointerrupter cooperating with the slitted disk. As the motor and, therefore, the slitted disk is rotated, the photointerrupter generates pulses continuously in synchronism with rotation of the motor. When no pulse appears within a predetermined period of time after the motor has been energized, it is determined that the an error has occurred in the drive system. A drawback with this kind of prior art control system is that it needs extra parts, i.e., the slitted disk and photointerrupter resulting in a complicated construction.

SUMMARY OF THE INVENTION

It is therefore an object of the present invention to provide a simple control device for a copier or similar image forming apparatus capable of detecting errors of a drive system which drives various driven units installed in a copier body.

It is another object of the present invention to provide a control device for a copier or similar image forming apparatus capable of detecting errors of a drive system which drives various driven units installed in a copier body, by using a toner sensor that is responsive to the density of a toner.

It is another object of the present invention to provide a generally improved control device for a copier or similar image forming apparatus.

In accordance with the present invention, in a control device for an image forming apparatus for controlling toner supply by sensing by a toner sensor a density of a toner image which is formed on an image carrier which is driven by a drive system, control means is provided to detect an error in the drive system in response to output data of the toner sensor.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
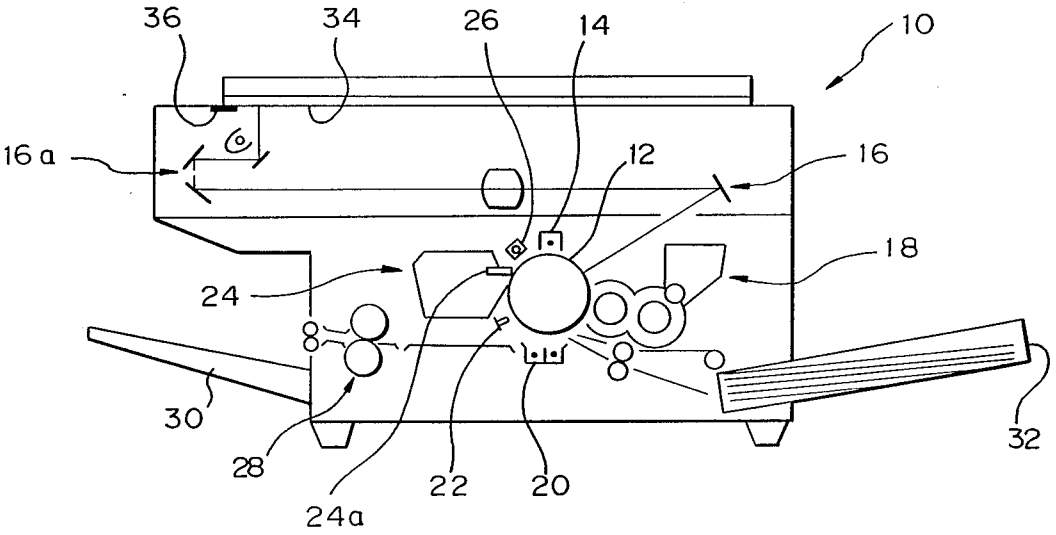
FIG. 1 a sectional view of a copier to which the present invention is applied.

Referring to FIG. 1 of the drawings, a copier to which the present invention is applied is shown and generally designated by the reference numeral 10. As shown, the copier 10 has a photoconductive element in the form of a drum 12. Arranged around the drum 12 are a main charger 14, optics 16 for imagewise exposure, a developing unit 18, a transfer and separation charger 20, a toner sensor 22 responsive to the density of a toner and implemented by a reflection type photosensor, a cleaning unit 24 having a cleaning blade **24*a*, and a discharge lamp 26. Further, the copier 10 has a fixing unit 28, a copy tray 30, a paper cassette 32, and a glass platen 34. The toner sensor 22 is made up of a light emitting diode (LED) 22*a* and a phototransistor 22*b*. A reference pattern 36 having a particular density, or reference density, is adhered to an end portion of the glass platen 34 to join in the control over toner density. The optics 16 includes a scanner 16*a*. The various units mentioned above, especially the drum 12, are driven by a drive system which includes a motor 50** (FIG. 2).

Figure 2:
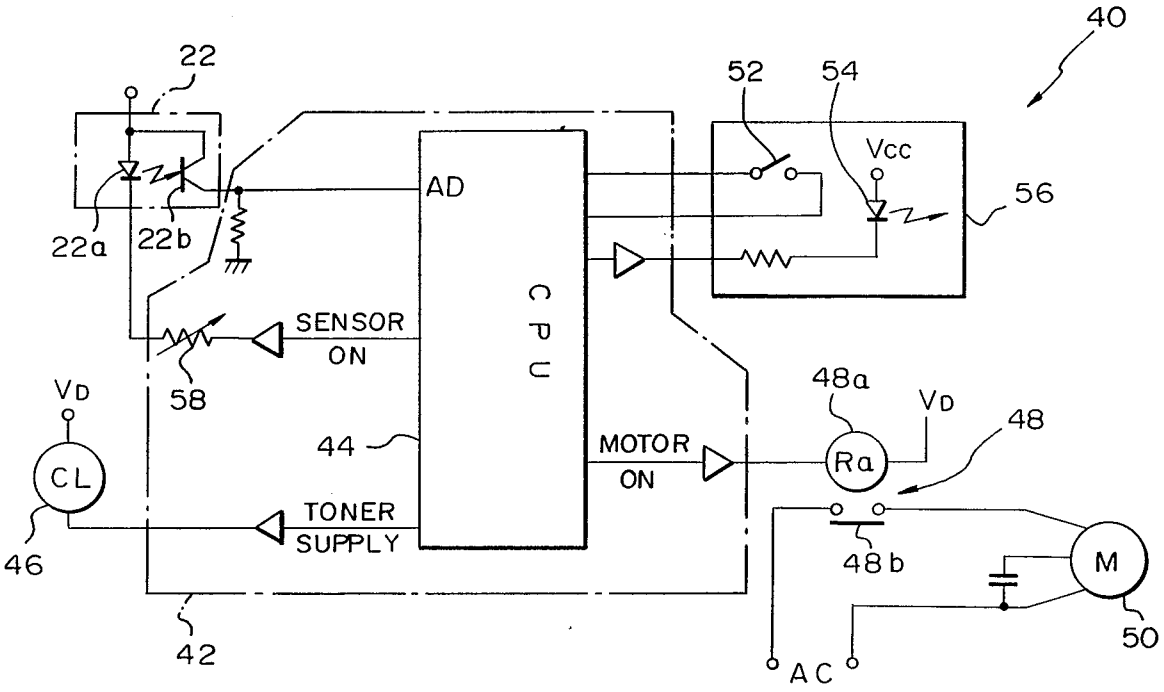
FIG. 2 a schematic block diagram showing a control device embodying the present invention.

Referring to FIG. 2, a control device embodying the present invention is shown in a schematic block diagram. The control device, generally 40, has a control circuit 42 which includes a CPU (Central Processing Unit) 44. The CPU 44 reads an output signal of the toner sensor 22 and loads an analog-to-digial (AD) converter built therein with the read signal. While delivering a command to the toner sensor 22, the CPU 44 feeds command signals to various clutches associated with the individual units of the copier 10 such as a toner supply clutch 46, a relay 48 for energizing the main motor 50, etc. Further, the CPU 44 interchanges signals with an operation board 56 on which a print key 52, an error display 54 and so forth are arranged. In the illustrative embodiment, the display 54 is represented by an LED by way of example. The relay 48 has a coil **48*a* and a contact 48*b*. When the contact 48*b* is closed by the coil 48*a*, AC power is fed to the main motor 50** to drive it.

A procedure for controlling the toner density will be outlined hereinafter. When the print key 52 on the operation board 56 is pressed, the scanner **16*a* of the optics 16 is driven to scan the reference pattern 36. An imagewise reflection from the reference pattern 36 is focused on the drum 12 which has been uniformly charged by the main charger 14. As a result, a latent image representative of the reference pattern 36 is electrostatically formed on the drum 12. The developing unit 18 transforms the latent image into a toner image. The toner sensor 22 is located between the cleaning unit 24 and the transfer and separation charger 20 to face the drum 12, and it senses the density of the toner image representative of the reference pattern 36. As shown in FIG. 2, a variable resistor 58 is operable to change the quantity of light issuing from the LED 22*a* of the toner sensor 22. Specifically, the variable resistor 58 is adjusted such that when the LED 22*a* is turned on, the input to the toner sensor 22, i.e., the output of the phototransistor 22*b* associated with the surface portion of the drum 12 where no toner is deposited is 3 volts. The output of the toner sensor 22 is coupled to the AD converter of the CPU 44. The CPU 44 compares an input voltage $V_o$ associated with the surface portion of the drum 12 where no toner is deposited and an input voltage $V_p$ associated with the surface portion where toner is deposited. When the voltage $V_o$ is equal to or lower than the voltage $V_p$ multiplied by 8, e.g., when $V_o$ is 3 volts and $V_p$ is 0.375 volts, the CPU 44 couples the toner supply clutch 46 for a predetermined duration to supply the toner. When the voltage $V_o$ is higher than the voltage $V_p$ multiplied by 8, the CPU 44 uncouples the toner supply clutch 46 to interrupt the toner supply. In practice, even if the output of the toner sensor 22 associated with the surface portion of the drum 12 where no toner is deposited is selected to be 3 volts, it constantly fluctuates by 0.3 volts or so due to the surface condition, eccentricity and other conditions of the drum 12**.

After the reference pattern density has been read, the cleaning unit 24 scrapes off the toner image representative of the reference pattern from the drum 12 with its blade 24*a*. The discharge lamp 26 dissipates the charge on the cleaned surface of the drum 12, and then the main charger 14 charges the drum surface again. Such toner density control is executed once per ten copies. While the toner supply clutch 46 is in an ON mode, it is turned on for a predetermined period of time for each copying.

Reference will be made to FIGS. 3, 4, 5A and 5B for describing error detection as performed by the illustrative embodiment.

Figure 3:
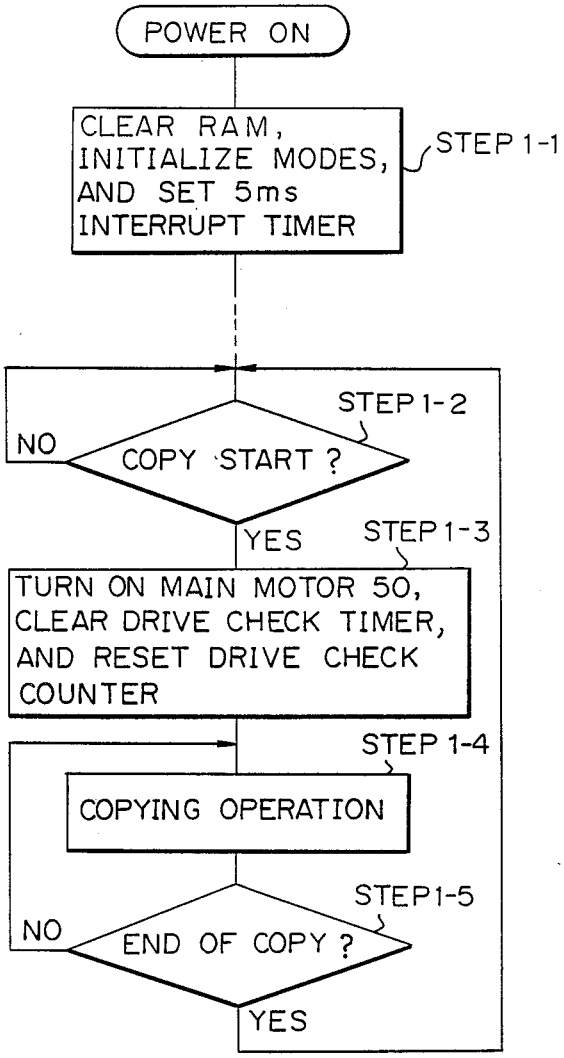
FIGS. 3 and 4 are flowcharts demonstrating operation of the control device shown in FIG. 2.

In a main routine shown in FIG. 3, on the turn-on of a power source, the CPU 44 clears a RAM, initializes modes, and sets a timer which effects an interrupt every 5 milliseconds (STEP 1—1). This allows a subroutine shown in FIG. 4, i.e., a subroutine for checking the drive system for an error to be executed every 5 milliseconds. The CPU 44 determines whether or not the print key 52 has been pressed (STEP 1-2) and, if the answer of STEP 1-2 is YES, turns on the main motor 50 while clearing a drive check timer (STEP 1-3). Then, a copying cycle is repeated until a desired number of copies have been produced (STEPs 1-4 and 1-5).

Figure 4:
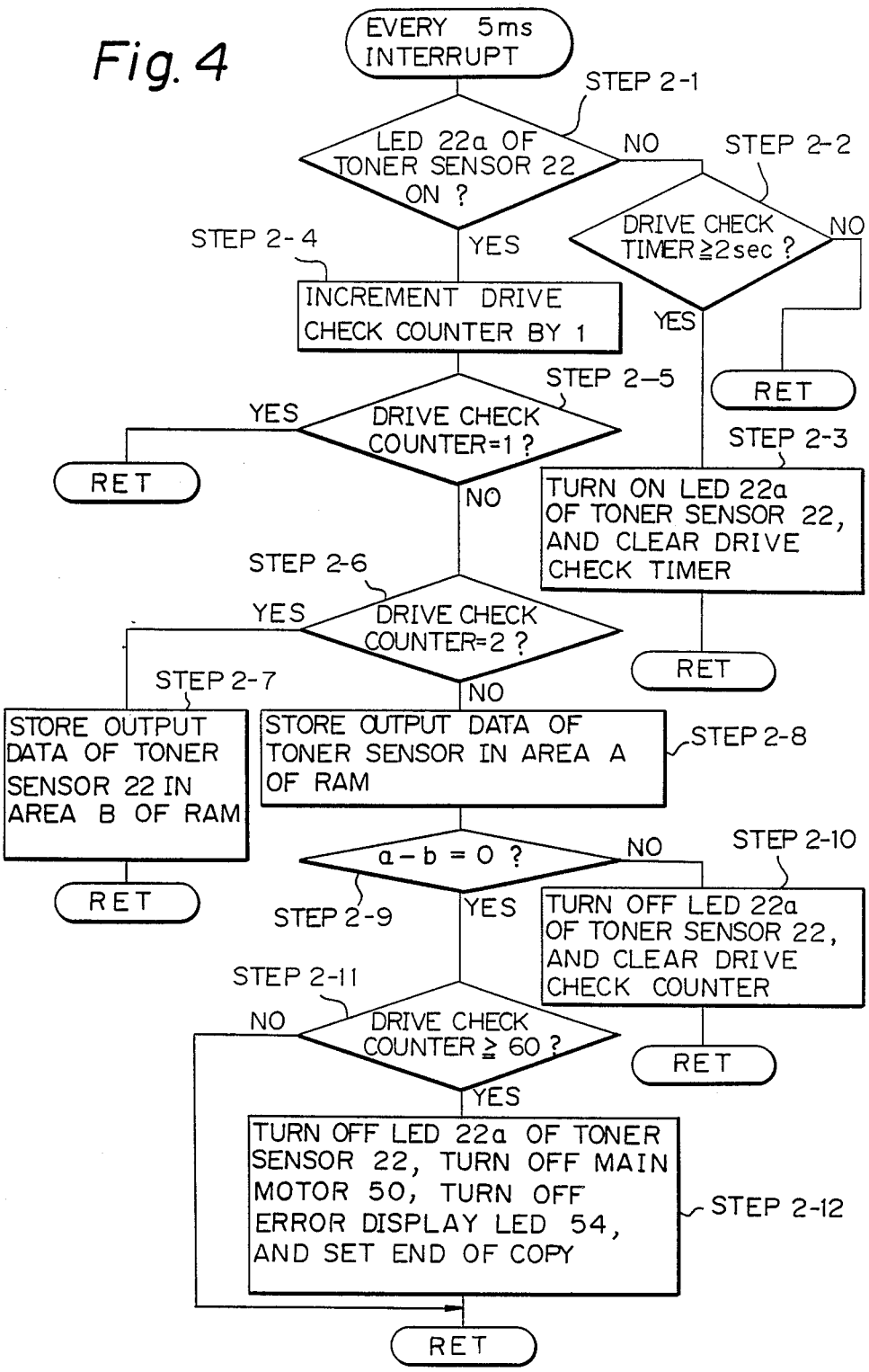

In the subroutine shown in FIG. 4, the CPU 44 determines whether or not the LED 22*a* of the toner sensor 22 has been turned on (STEP 2-1) and, if the answer of STEP 2-1 is NO, checks the drive check timer to see if it has counted two seconds during the copying operation (STEP 2—2). If the answer of STEP 2—2 is YES, the CPU 44 turns on the LED 22*a* and clears the drive check timer to start on a drive error check procedure (STEP 2-3). If the LED 22*a* has been turned on as decided in STEP 2-1, the CPU 44 increments a drive check counter by 1 (one) at the instant of interruption which occurs 5 milliseconds later (STEP 2-4). Subsequently, the CPU 44 determines whether or not the output of the toner sensor 22 has become stable (STEP 2-5) and, if it has not become stable, discards the output data of the sensor 22. On the lapse of 10 milliseconds when the output of the sensor 22 becomes sufficiently stable (STEP 2-6), the CPU 44 stores data read via the toner sensor 22 in an area B of the built-in RAM (STEP 2-7). Thereafter, output data of the toner sensor 22 are sequentially stored in an area A of the RAM in response to an interruption which occurs every 5 milliseconds (STEP 2-8). The CPU 44 compares data *a* and *b* which are stored in the areas A and B, respectively (STEP 2-9). If the data *a* and *b* do not compare equal, the CPU 44 turns off the LED 22*a* of the toner sensor 22, clears the drive check counter (STEP 2-10), and terminates the error check procedure, determining that the drum 12 has been driven by the motor 50. More specifically, the CPU 44 allows the copying operation to be continued by determining that the drive system is free from errors. If the data *a* and *b* are equal as decided in STEP 2-9, the CPU executes the check every five milliseconds by up to sixty times of interruption (5 milliseconds × 60 = 300 milliseconds), until the data *a* and *b* become different from each other (STEP 2-11). Assuming that the drum 12 remains in halted mode then the toner sensor 22 will read the same surface portion of the drum 12 continuously and, hence, the output data thereof will not change. In the illustrative embodiment, if the data *a* and *b* remain the same even when the drive check counter is incremented to 60 (= 300 milliseconds) or greater (STEP 2-11), the CPU 44 determines that the drum 12 is in a halt and, therefore, the drive system has failed. Then, the CPU 44 deenergize the main motor 50 and turns on the LED 54 for displaying the error (STEP 2-12).

Figure 5A:
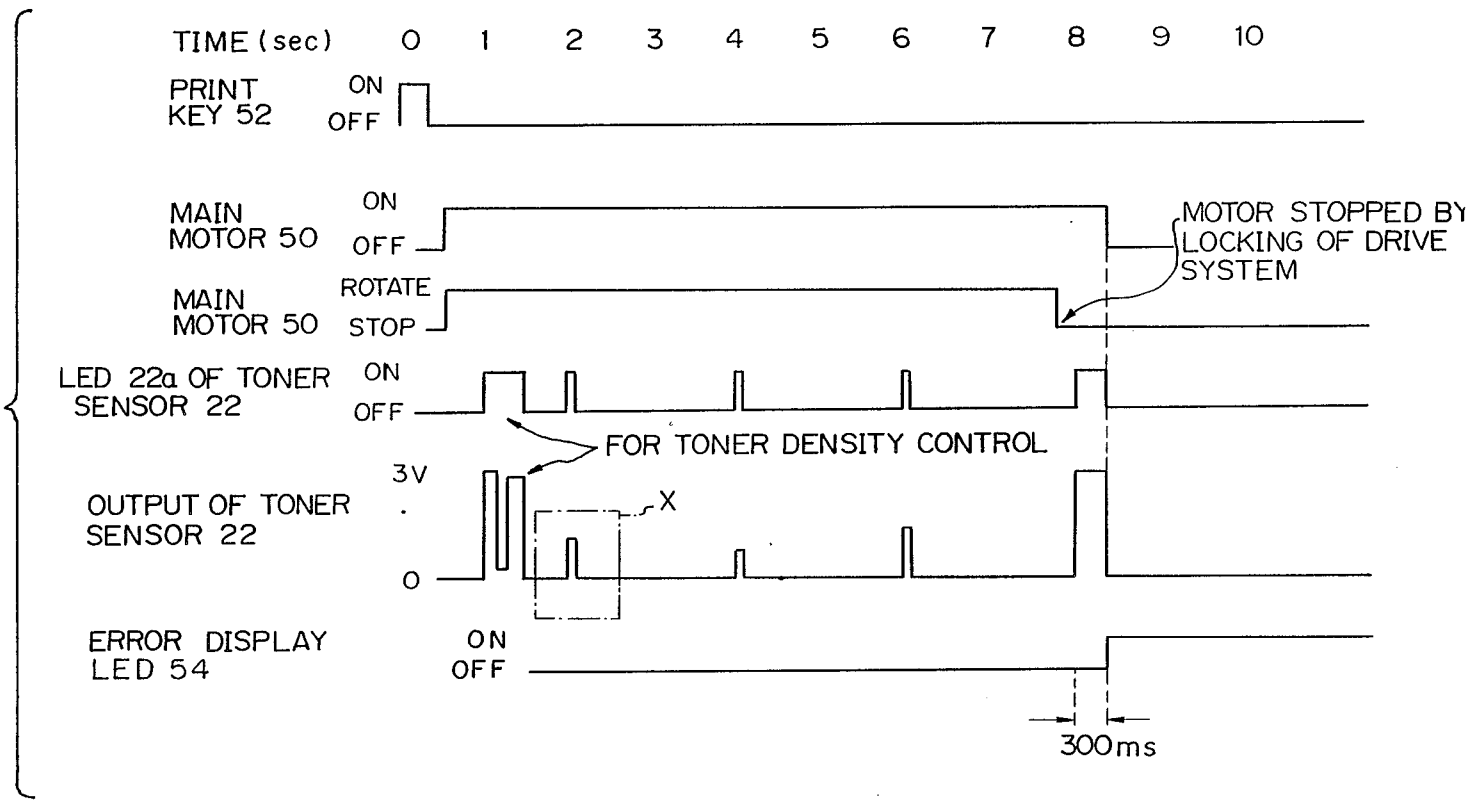
FIGS. 5A and 5B are timing charts representative of the operations of various sections which constitute the control device of FIG. 2.
Figure 5B:
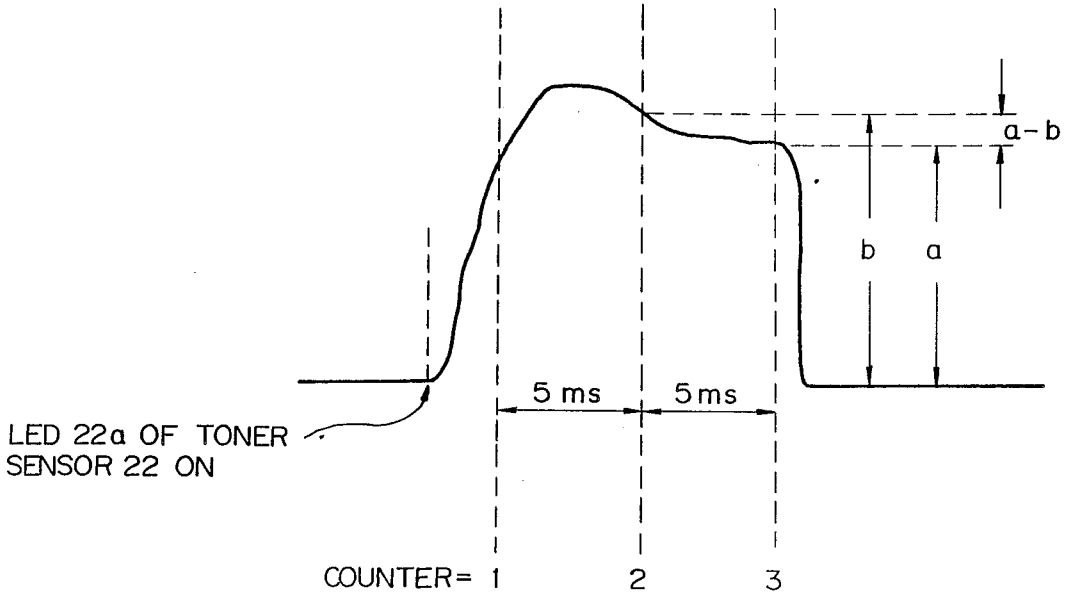

FIGS. 5A and 5B are timing charts associated with the specific error check procedure which has been described above with reference to FIGS. 3 and 4. It is to be noted that a part of the output signal of the toner sensor 22 which is indicated by a dash-and-dot line X in FIG. 5A is shown in an enlarged scale in FIG. 5B.

With the above-described construction and operation, it is possible to check the drive system of the copier 10 for errors.

While the toner sensor 22 is implemented by a photosensor responsive to the density of a toner image formed on the drum 12 and representative of a reference pattern, it may of course be replaced with a sensor which is associated with the developing unit 14 itself and responsive to the toner density of a developer stored in the unit 14. The illustrative embodiment is similarly applicable to a copier of the type using an induction motor in place of a synchronous motor.

In summary, in accordance with the present invention, errors of a copier drive system which includes a motor can be detected by using a toner sensor which is ordinarily incorporated in a copier for sensing toner density. The present invention, therefore, contributes a great deal to the reduction of the number of components and structural elements of a control device.

Various modifications will become possible for those skilled in the art after receiving the teachings of the present disclosure without departing from the scope thereof.

What is claimed is:

1. In a control device for an image forming apparatus for controlling toner supply by sensing by a toner sensor a density of a toner image which is formed on an image carrier which is driven by a drive system, an improvement comprising:

control means for detecting an error of the drive system in response to output data of the toner sensor, wherein said control means comprises reading output data of the toner sensor at predetermined intervals while comparing first and second individual output data which are read by said reading means and determining means for determining, when the output data do not compare so as to be equal, that the drive system is operating normally.

2. A control device as claimed in claim 1, wherein said determining means of said control means determines when the output data compare so as to be equal, that the image carrier has not been driven by the drive system and that, therefore, an error has occurred in said drive system.

3. A control device as claimed in claim 2, wherein said control means comprises executing means for executing, when the output data compare so as to be equal, error checking operation a predetermined number of times until the output data become different from each other.

4. A control device as claimed in claim 1, wherein said toner sensor includes means for producing the output data by sensing the surface portion of said image carrier where no toner image is formed when said error checking operation is executed.

* * * * *